US005419563A

United States Patent [19]

Abrams et al.

[11] Patent Number: 5,419,563

[45] Date of Patent: May 30, 1995

[54] PRESSURE-SENSITIVE GRIP MEASURING DEVICE

[76] Inventors: Jack Abrams, 6 Pinewood Dr.; Harold Juman, 32 Raybor Rd., both of Commack, N.Y. 11725; Morton Glick, 5 Simon Ct., East Northport, N.Y. 11731

[21] Appl. No.: 260,110

[22] Filed: Jun. 15, 1994

Related U.S. Application Data

[63] Continuation-in-part of Ser. No. 11,182, Jan. 29, 1993, Pat. No. 5,322,289.

[51] Int. Cl.[6] ..... A63B 69/36

[52] U.S. Cl. ..... 273/187.5

[58] Field of Search ..... 273/186.2, 186.3, 186.4, 273/187.4, 187.5, 29 A, 26 B

[56] References Cited

U.S. PATENT DOCUMENTS

| | | | |
|---|---|---|---|
| 3,111,322 | 11/1963 | English | 273/187.5 |
| 3,897,058 | 7/1975 | Koch | 273/187.5 X |
| 4,027,879 | 6/1977 | Wright | 273/187.5 X |
| 4,103,896 | 8/1978 | Lorang | 273/187.5 |
| 4,138,118 | 2/1979 | Budney | 273/187.5 |
| 4,861,034 | 8/1989 | Lee | 273/81.2 |
| 4,930,785 | 6/1990 | Mills | 273/194 R X |
| 5,322,289 | 6/1994 | Abrams et al. | 273/187.5 |

*Primary Examiner*—George J. Marlo
*Attorney, Agent, or Firm*—Klauber & Jackson

[57] ABSTRACT

A pressure-sensitive grip measuring device 10 for use in training or assisting athletes in developing a proper hand grip. The device 10 includes a pressure-sensitive grip 14 comprising an electrically conductive shaft 12 having a plurality of grooves 22 formed annularly therein, a like plurality of elastic insulating rings 24 disposed in the plurality annular grooves 22, and an electrically conductive wrapping 26 disposed annularly around the electrically conductive shaft 12 and the elastic insulating rings 24. The electrically conductive wrapping 26 is typically covered by a non-electrically conductive protective material such as a rubber golf club grip. The device 10 also includes a housing 16, attached to one end of the electrically conductive shaft 12, for retaining a battery 18 and a user detectable indicator 20. An electrical circuit is formed in the device 10 such that a normally open switch is formed between the electrically conductive wrapping 26 and the electrically conductive shaft 12. When an improper amount of pressure is applied by a user to the pressure-sensitive grip 14 the switch is closed and the indicator 20 becomes active. Thus, the user is alerted when such an improper amount of pressure is applied.

24 Claims, 6 Drawing Sheets

PRESSURE-SENSITIVE GRIP MEASURING DEVICE

CROSS-REFERENCE TO RELATED APPLICATIONS

This application is a continuation-in-part application of U.S. patent application Ser. No. 08/011,182 filed on Jan. 29, 1993, now U.S. Pat. No. 5,322,289.

FIELD OF THE INVENTION

The present invention relates to hand grip instructional aids and, more particularly, to a device that indicates when a user is applying an improper amount of pressure to a hand grip of a golf club, a tennis racket, or any number of other hand manipulated implements.

DESCRIPTION OF THE PRIOR ART

There are various sports which require an athlete to utilize a club or some other hand manipulated implement for swinging at a ball which is fixed at a stationary position in front of the athlete or else is rapidly advancing toward the athlete. An example of such a sport is golf, wherein the golfer utilizes a golf club to drive a stationary golf ball that is positioned either on a golf tee or on the ground in front of him. In other sports, such as tennis or baseball, the athlete utilizes a tennis racket or a baseball bat, respectively, for swinging at a rapidly approaching ball. In all of the above mentioned sports, and numerous others, it has been found that the athlete's grip on the associated athletic club plays an important role in the final direction and control of the ball.

To assist an athlete in developing a proper grip on an athletic club or other hand manipulated implement, several inventive efforts have been made. For example, U.S. Pat. Nos. 4,930,785, 4,103,896, 4,138,118, 3,897,058, 4,861,034 and 4,027,879, all address various methods of assisting an athlete in developing a proper grip. A brief description of these prior art devices is now given.

U.S. Pat. No. 4,930,785 (Mills) discloses a golf grip handle incorporating a battery operated electrical circuit that is activated in response to excessive grip pressure at a particular point along the handle. The electrical circuit is connected to a motor that produces vibrations in the handle so as to alert the user of the excessive grip pressure.

U.S. Pat. No. 4,103,896 (Lorang) discloses a golf club handle which includes a switch to be placed under the middle fingers of one of the user's hands to provide an output signal if excessive pressure is applied by those fingers. Typically, the switch is placed under the middle finger of the user's right hand to sense excessive pressure and to provide an output signal as a result of the excessive pressure.

U.S. Pat. No. 4,138,118 (Budney) discloses a strain gauge on a handle of a golf club to sense an applied pressure of a user's fingers on the handle. A plurality of strain gauges may be placed axially on the handle so that the pressure of the fingers at several locations on the handle may be sensed. The strain gauge(s) are connected to a pen recorder to record the output of the gauge(s) continuously during the user's golf swing. The apparatus requires a cord extending from the handle to the pen recorder which may be distracting to the user.

U.S. Pat. No. 3,897,058 (Koch) discloses a training aid apparatus for achieving a correct grip on a golf club, tennis racket, baseball bat, etc., that requires a pressure responsive grip. The apparatus includes a hollow handle connected to a pressure gauge so that the force of the user's hands can be sensed. The sensed pressure is remote from the user, and accordingly there is no sensation or output indication to the used while he or she is swinging. An instructor apparently observes the output pressure. Since the sensing is remote, the handle being gripped is connected to the pressure gauge by a cord, which may be distracting to the user.

U.S. Pat. No. 4,861,034 (Lee) discloses a golf grip training device that may be installed on a conventional golf club. The device includes an elongated pressure sensitive switch that is mounted to the underside of the golf club handle and that is responsive to a user's grip pressure. The switch is connected to a signalling device that is further mounted to the golf club which emits an audible signal when a predetermined grip pressure is exceeded.

U.S. Pat. No. 4,027,879 (Wright) discloses a tennis racket grip training device which operates upon a form of translation of pressure, whereby an excessive application of pressure to the tennis racket handle causes a partial disengagement of the handle from its connecting shaft, thereby producing both a visible and an audible indication of an improper hand grip.

Although all of the above-mentioned prior art devices provide various methods of assisting an athlete in developing a proper grip, none propose a device having a handle construction specifically comprising an electrically conductive shaft having a plurality of grooves formed annularly therein, a like plurality of elastic insulating rings disposed in the plurality annular grooves, and an electrically conductive wrapping disposed annularly around the shaft and the elastic insulating rings which, all acting in combination, allow for a sensing of improper pressure being applied to the handle by a user thereof. Such a device would be desirable for training in the sports of golf, tennis, baseball, and numerous others where an athlete's grip plays an important role in his or her performance. It is therefore desirable to provide such a device and to overcome the shortcomings of the above-mentioned prior art devices in this area.

SUMMARY OF THE INVENTION

The present invention contemplates a pressure-sensitive grip measuring device that can be used to train or assist athletes in developing a proper hand grip. The device provides a handle construction comprising an electrically conductive shaft having a plurality of grooves formed annularly therein, a like plurality of elastic insulating rings disposed in the plurality annular grooves, and an electrically conductive wrapping disposed annularly around the electrically conductive shaft and the elastic insulating rings. The electrically conductive wrapping is typically covered by a protective material; for example, in the case of a golf club grip measuring device, the electrically conductive wrapping is covered by a rubber golf club grip.

The electrically conductive shaft has a weight or is weighted to duplicate the weight and inertia of the actual club or hand implement for which the athlete user will be trained. Within the electrically conductive shaft, or attached thereto, a battery and a user detectable indicator are present, thereby forming a first of two parts of an electrical circuit. The second part of the electrical circuit is comprised of a pressure sensitive switch which is formed between the electrically conductive shaft and the electrically conductive wrapping which is disposed annularly thereabout. The switch is closed when the annularly disposed electrically conductive wrapping comes into contact with the electrically conductive shaft, which results in the user detectable indicator becoming active.

Of course, the electrically conductive shaft and the annularly disposed electrically conductive wrapping are usually separated from each other by the elastic insulating rings. In fact, the elastic insulating rings are chosen with certain resilient characteristics in mind such that when an excessive pressure is applied to the outer protective material the annularly disposed electrically conductive wrapping is allowed to come into contact with the electrically conductive shaft, and when such an excessive pressure is removed the annularly disposed electrically conductive wrapping and the electrically conductive shaft are again separated from each other by the elastic insulating rings.

From the above descriptive summary, it is thus apparent how the specific construction of the present invention pressure-sensitive grip measuring device overcomes the shortcomings of the above-mentioned prior art devices.

Accordingly, the primary objective of the present invention is to provide a pressure-sensitive grip measuring device that can be used to train or assist athletes in developing a proper hand grip.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention pressure-sensitive grip measuring device, reference is now made to the appended drawings. These drawings should not be construed as limiting the present invention, but are intended to be exemplary only.

PREFERRED EMBODIMENTS OF THE PRESENT INVENTION

Figure 1:
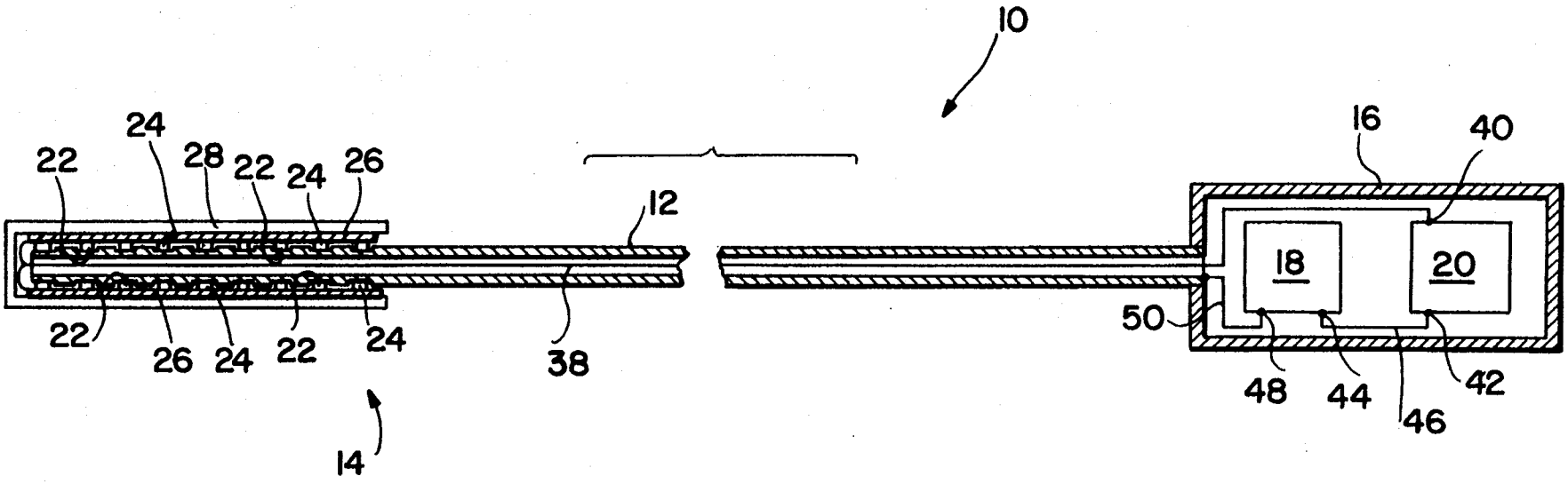
FIG. 1 is a side cross-sectional view of a first embodiment of a pressure-sensitive grip measuring device according to the present invention for use in training or assisting golfers in developing a proper hand grip.

Referring to FIG. 1, there is shown a first embodiment of a pressure-sensitive grip measuring device 10 according to the present invention for use in training or assisting golfers in developing a proper hand grip. The device 10 comprises a shaft 12 having a pressure-sensitive grip 14 formed at a first end thereof and a housing 16 attached at a second end thereof. The housing 16 holds a battery 18 and a user detectable indicating device 20. The indicating device 20 may be in the form of a buzzer or a light, or a similar type of active detectable indicating device. The shaft 12, the pressure-sensitive grip 14, and the housing 16 are all weighted so as to duplicate the weight and inertia of an actual golf club. It should be noted that the length of the shaft 12 in this first embodiment should be shorter than an actual golf club shaft so as to discourage the actual hitting of golf balls which could damage the housing 16.

The shaft 12 is made of an electrically conductive material and is either formed with or has machined therein a plurality of annular grooves 22 at the first end thereof. Fitted within each of the plurality of grooves 22 is an elastic insulating ring 24 having an outer diameter slightly larger than the outer diameter of the non-grooved areas of shaft 12. Disposed annularly around the shaft 12 and the elastic insulating rings 24 is a wrapping 26 having an interior surface comprised of an electrically conductive material. The annular wrapping 26 is typically covered by a non-electrically conductive protective material 28 such as rubber or leather.

Figure 2:
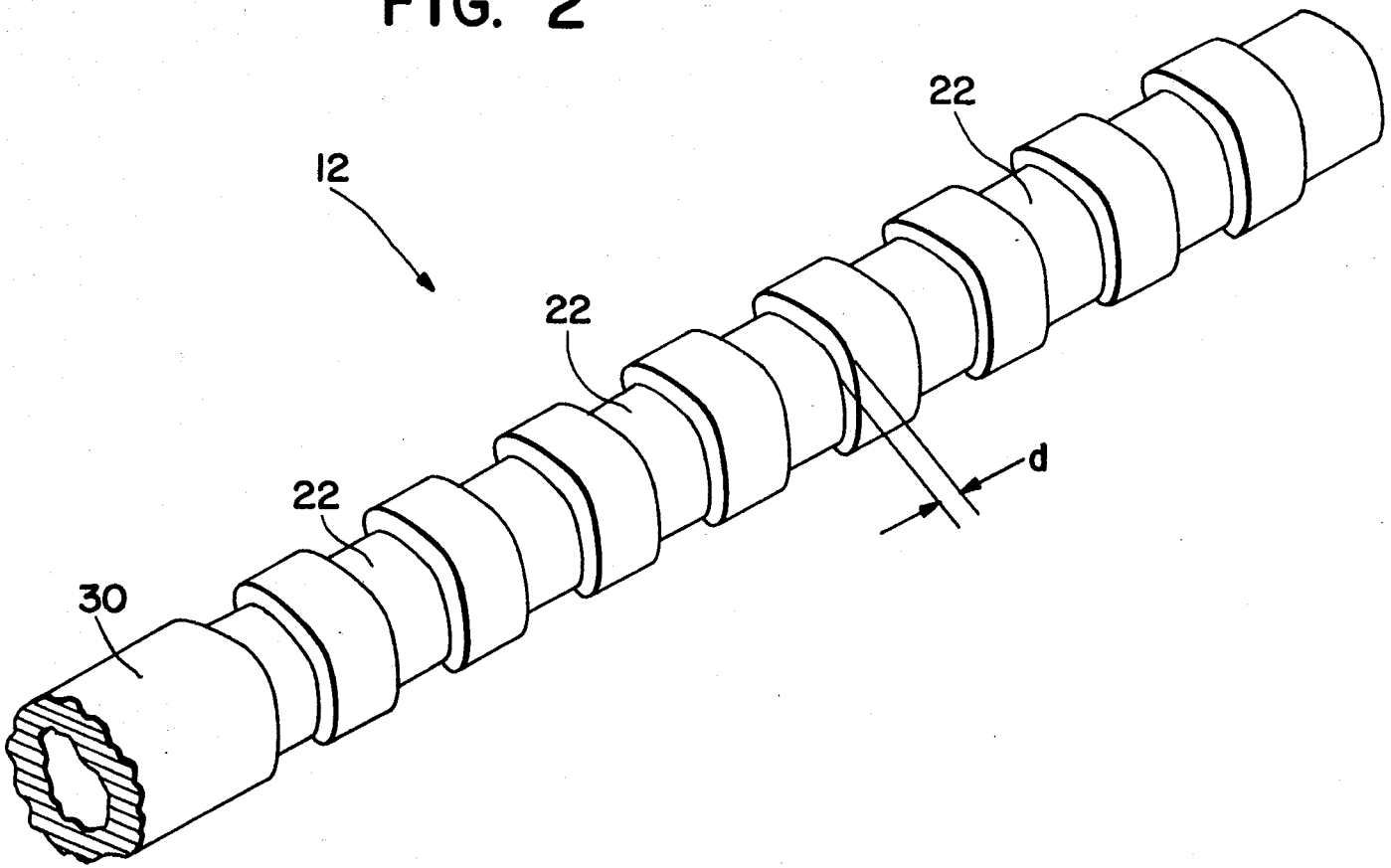
FIG. 2 is a three-dimensional sectional view of a first end of an electrically conductive shaft that is used in the present invention pressure-sensitive grip measuring device shown in FIG. 1.

Referring to FIG. 2, there is shown a three-dimensional sectional view of the first end of the shaft 12. The shaft 12 is comprised of a cylindrical tubular body 30 having the plurality of annular grooves 22 formed therein. The depth of each groove 22 is shown having a dimension, d. The shaft 12 is made of an electrically conductive rigid metal material such as aluminum or steel.

Figure 3:
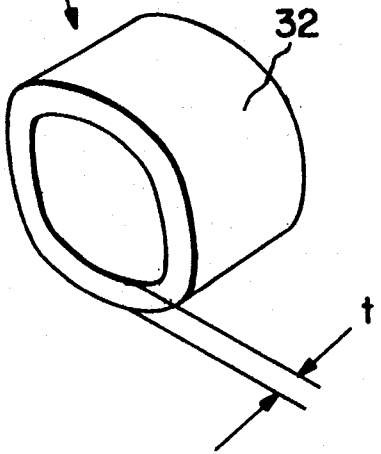
FIG. 3 is a three-dimensional view of an elastic insulating ring that is used in the present invention pressure-sensitive grip measuring device shown in FIG. 1.

Referring to FIG. 3, there is shown a three-dimensional view of one of the plurality of elastic insulating rings 24. Each elastic insulating ring 24 is comprised of a cylindrical tubular body 32. The wall of the cylindrical tubular body 32 is shown having a thickness, t. Each elastic insulating ring 24 is made of a non-electrically conductive resilient material such as rubber.

Figure 4:
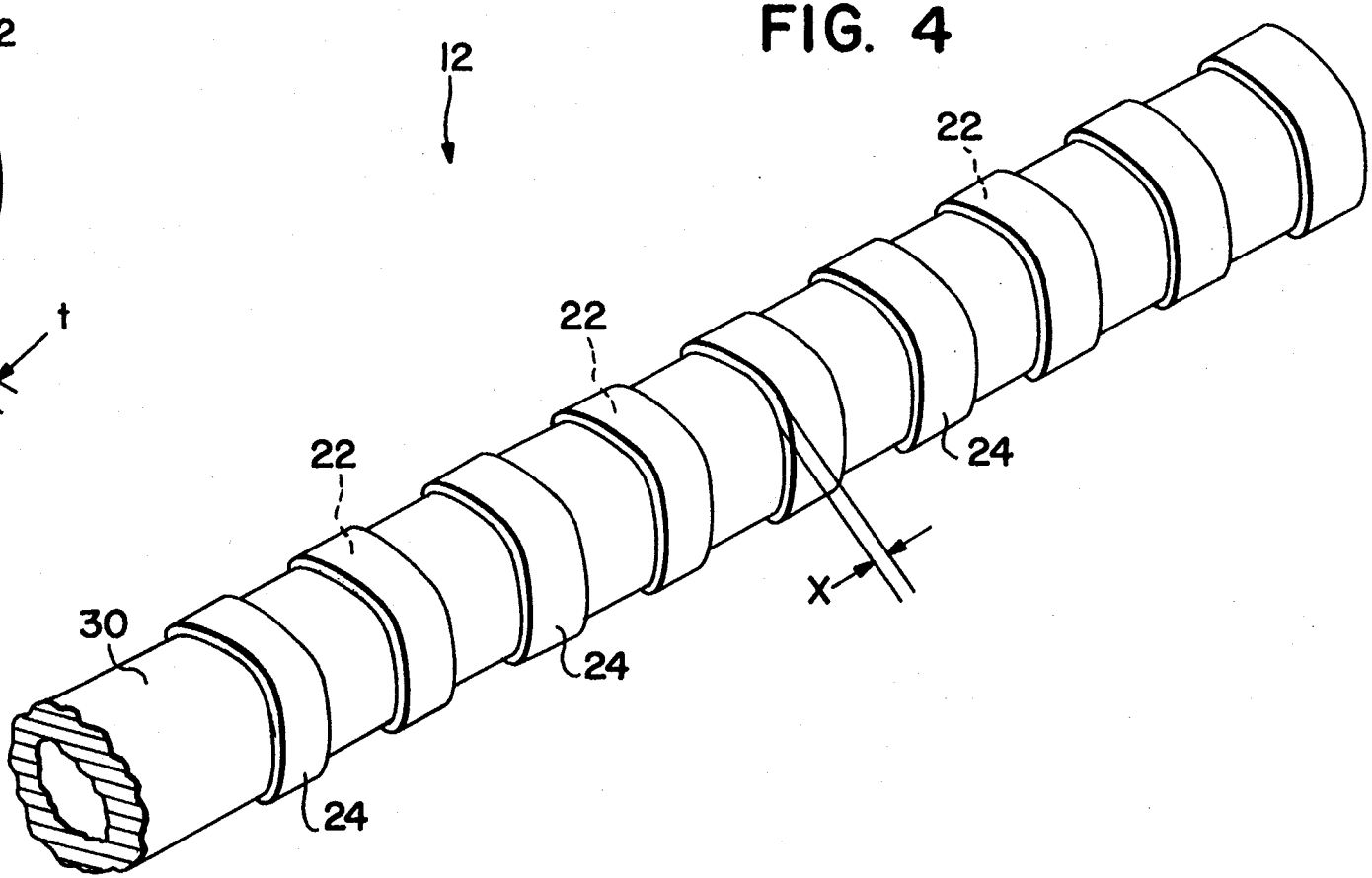
FIG. 4 is a three-dimensional sectional view of the first end of the electrically conductive shaft shown in FIG. 2 fitted with the elastic insulating rings shown in FIG. 3.

Referring to FIG. 4, there is shown a three-dimensional sectional view of the first end of the shaft 12 with each annular groove 22 being fitted with an elastic insulating ring 24. The difference between the outer diameter of the non-grooved areas of the shaft 12 and the outer diameter of the elastic insulating rings 24 is shown to be a distance, x. The distance, x, is obtained according to the following formula, $$t-d=x.$$

It should be noted that the outer diameter of the cylindrical tubular body 30 of the shaft 12 in the area of the grooves 22 is approximately the same as the inner diameter of the cylindrical tubular body 32 of each elastic insulating ring 24 so as to insure a snug fit between the two.

Figure 5:
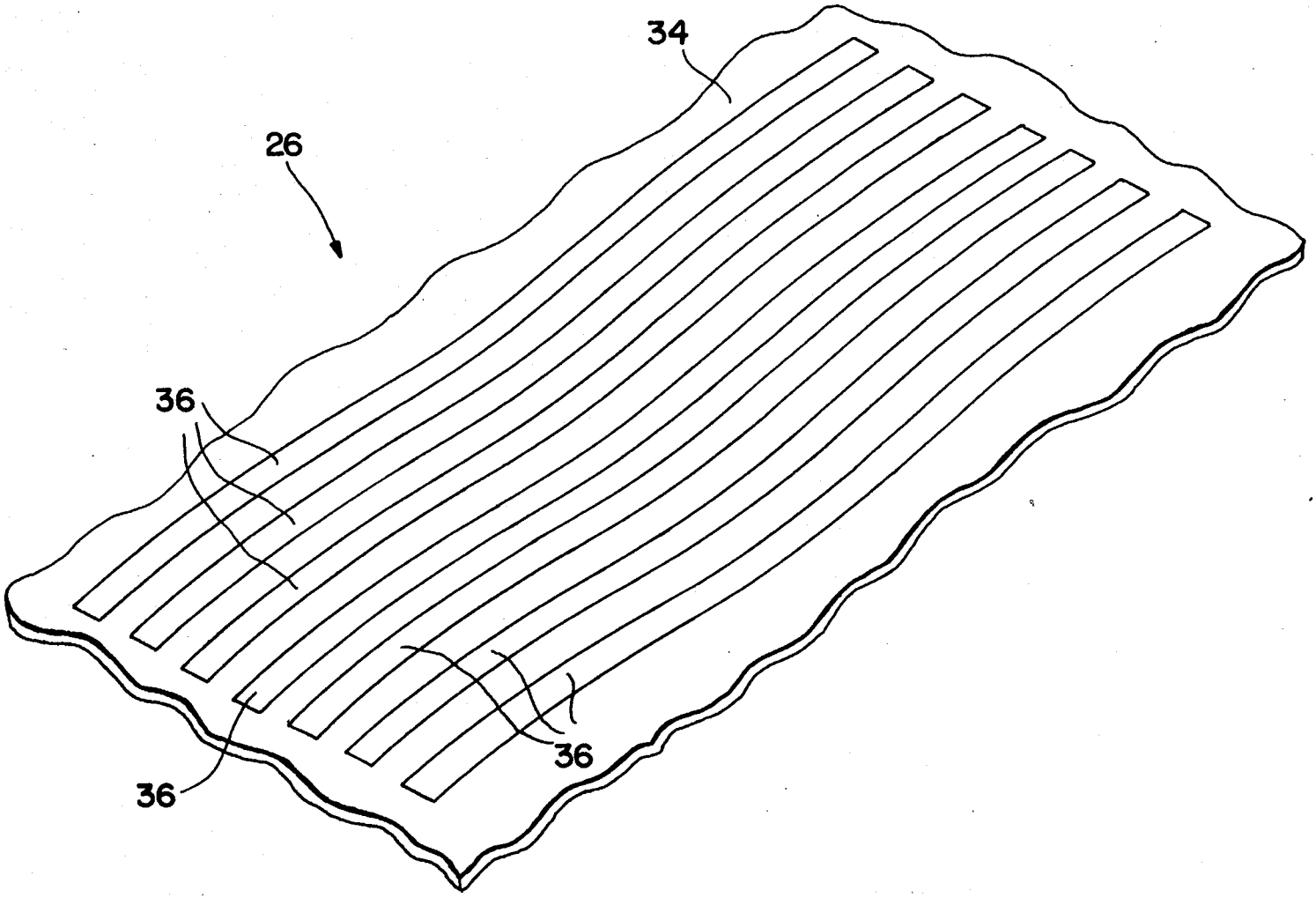
FIG. 5 is a three-dimensional view the wrapping that is used in the present invention pressure-sensitive grip measuring device shown in FIG. 1.

Referring to FIG. 5, there is shown a three-dimensional view the wrapping 26. The wrapping 26 is comprised of a piece of double-backed tape 34 having a plurality of strips of electrically conductive material 36 fastened to one side thereof. The strips of electrically conductive material 36 are made of a thin, somewhat deformable, metal material such as copper. The purpose of using double-backed tape 34 is threefold. First, it allows the strips of electrically conductive material 36 to be secured thereto. Second, it allows the side of the wrapping 26 having the strips of electrically conductive material 36 (the interior side) to be fastenably wrapped around the shaft 12 and the elastic insulating rings 24. Third, it provides an adhesive surface (the exterior side) to which the outer protective material 28 is fastened.

Figure 6:
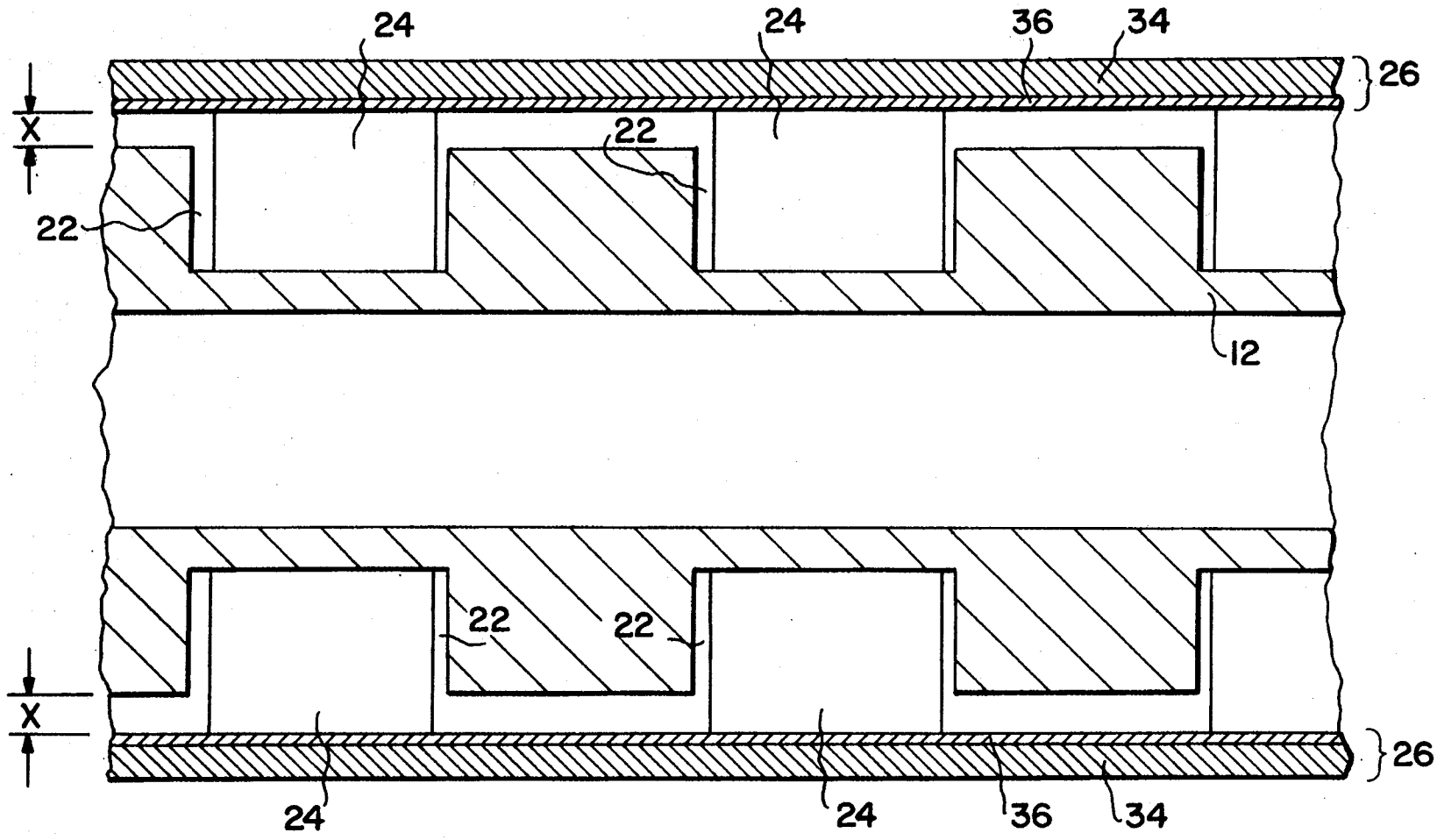
FIG. 6 is an enlarged side cross-sectional view of the present invention pressure-sensitive grip measuring device shown in FIG. 1.

Referring to FIG. 6, there is shown an enlarged side cross-sectional view of the present invention pressure-sensitive grip measuring device 10 with the outer protective material 28 removed. From this view it can be seen that the wrapping 26, comprised of the double-backed tape 34 with the strips of electrically conductive material 36 secured to the interior side thereof, is annularly disposed around the shaft 12 and the elastic insulating rings 24 so that the strips of electrically conductive material 36 are in constant contact with the elastic insulating rings 24 and, with no external pressure applied to the wrapping 26, are normally separated from the non-grooved areas of the shaft 12 by the distance, x. As will be explained shortly in more detail, when a specific amount of external pressure is applied to the wrapping 26, the elastic insulating rings 24 become deformed thereby allowing the strips of electrically conductive material 36 to contact the non-grooved areas of the shaft 12.

Referring again to FIG. 1, the strips of electrically conductive material 36 are electrically connected to a first terminal 40 of the indicating device 20 by way of a first wire 38. A second terminal 42 of the indicating device 20 is electrically connected to a first terminal 4 of the battery 18 by way of a second wire 46. Finally, a second terminal 48 of the battery 18 is electrically connected to the shaft 12 by way of a third wire 50. As previously mentioned, the shaft 12 is made of an electrically conductive material.

Since the elastic insulating rings 24 are deformable so as to allow the strips of electrically conductive material 36 to contact the non-grooved areas of the electrically conductive shaft 12, but the elastic insulating rings 24 are such that they normally separate the strips of electrically conductive material 36 from the non-grooved areas of the electrically conductive shaft 12, a normally open electrical switch is thus formed. This switch is closed when a specific amount of external pressure is applied to the outer protective material 28, and hence to the wrapping 26 and the elastic insulating rings 24, so that the strips of electrically conductive material 36 come into contact with the non-grooved areas of the electrically conductive shaft 12. When such an event occurs, an electrical circuit is closed and the indicating device 20 becomes active. It should be noted that the circuit positions of the battery 18 and the indicating device 20 are interchangeable. It should further be noted that the first 38, second 46, and third 50 wires are typical copper wires.

To use the above-described electromechanical apparatus as a pressure-sensitive grip measuring device, the thickness and composition of the elastic insulating rings 24 are chosen to deform by an amount equal to the distance, x, when a specific amount of external pressure is applied thereto. This specific amount of external pressure corresponds to an improper, or more appropriately an excessive, amount of external pressure being applied to an actual golf club grip. Thus, when a user applies this excessive external pressure to the pressure-sensitive grip 14, electrical contact is made between the strips of electrically conductive material 36 and the non-grooved areas of the electrically conductive shaft 12 so that the indicating device 20 becomes active, thereby alerting the user accordingly. Conversely, when a user applies less than the above-described specific amount of external pressure, the indicating device 20 will remain in a normally inactive state and the user thereby knows that improper pressure is not being applied.

Figure 7:
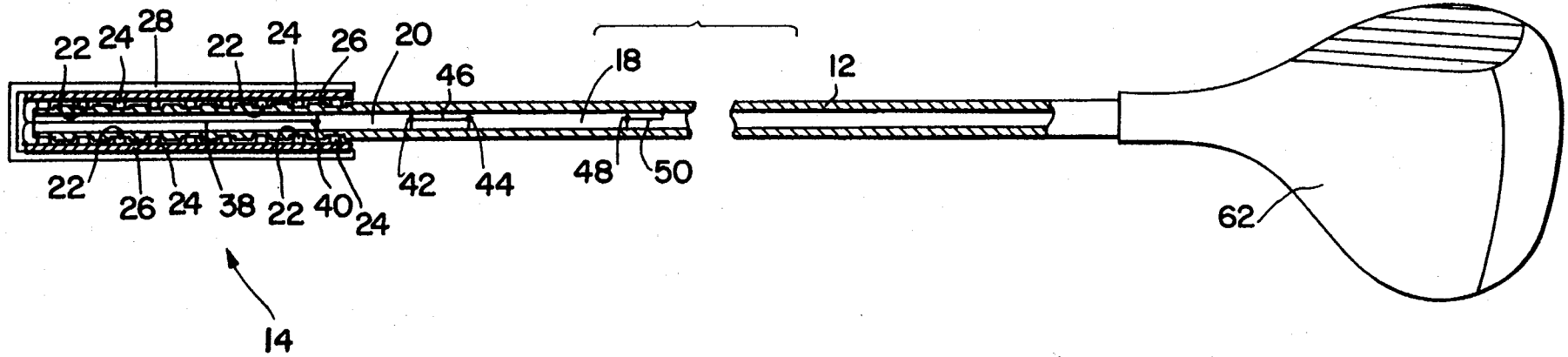
FIG. 7 is a side cross-sectional view of a second embodiment of a pressure-sensitive grip measuring device according to the present invention for use in training or assisting golfers in developing a proper hand grip.

Referring to FIG. 7, there is shown a present invention pressure-sensitive grip measuring device 60 having an alternate embodiment to that of the device 10 shown in FIG. 1. In this alternate embodiment device 60 the battery 18 and the indicator 20 are secured within the shaft 12 so that a typical golf club head 62 may be attached to the second end of the shaft 12. Consequently, the shaft 12 may have the length of an actual golf club shaft, thereby allowing the user to develop a proper grip by using the present invention device 60 in a more realistic manner.

The relatively simple nature of the above-described present invention, although described herein in the form of golf grip measuring devices 10,60 allows for easy adaption to other applications, such as tennis racket and baseball bat grip measuring devices. Accordingly, with the present invention pressure-sensitive grip measuring devices 10,60 now fully described it can thus be seen that the primary objective set forth above is efficiently attained and, since certain changes may be made in the above described devices 10,60 without departing from the scope of the invention, it is intended that all matter contained in the above description or shown in the accompanying drawings shall be interpreted as illustrative and not in a limiting sense.

What is claimed is:

1. A pressure-sensitive grip measuring device for training or otherwise assisting users in perfecting a proper hand grip, said pressure-sensitive grip measuring device comprising:

pressure-sensitive grip means resembling a grip portion of a hand manipulated implement, said grip means comprising an electrically conductive shaft having a plurality of grooves formed annularly therein at a first end thereof, an elastic insulating ring disposed in each of said plurality annular grooves, and an electrically conductive wrapping disposed annularly around said electrically conductive shaft and said elastic insulating rings but separated from said electrically conductive shaft by a predetermined distance;

electrical indicator means becoming active when a user has applied an improper amount of external pressure to said grip means, said improper amount of external pressure attained when said elastic insulating rings allow said electrically conductive wrapping to be deflected said predetermined distance so as to be in contact with said electrically conductive shaft;

battery means for supplying an electrical current to said electrical indicator means for activating the same; and circuit means for electrically connecting together said battery means, said electrical indicator means, said electrically conductive wrapping, and said electrically conductive shaft, in a manner such that an electrical circuit with a normally open switch between said electrically conductive wrapping and said electrically conductive shaft is formed, wherein said normally open switch is closed when said user has applied said improper amount of external pressure to said grip means, thereby activating said electrical indicator means and alerting said user accordingly.

2. The pressure-sensitive grip measuring device as defined in claim 1, further comprising a housing for holding said electrical indicator means and said battery means, said housing attached to said electrically conductive shaft at a second end thereof.

3. The pressure-sensitive grip measuring device as defined in claim 2, wherein said grip means, said housing, and said circuit means are weighted so as to simulate an actual weight of said hand manipulated implement.

4. The pressure-sensitive grip measuring device as defined in claim 3, wherein said grip means further comprises a protective material annularly disposed around said electrically conductive wrapping.

5. The pressure-sensitive grip measuring device as defined in claim 4, wherein said electrically conductive shaft is made of an electrically conductive rigid metal material such as aluminum or steel.

6. The pressure-sensitive grip measuring device as defined in claim 4, wherein said elastic insulating rings are made of a non-electrically conductive resilient material such as rubber.

7. The pressure-sensitive grip measuring device as defined in claim 4, wherein said electrically conductive wrapping is comprised of:

a sheet of double-backed tape; and a plurality of strips of electrically conductive material fastened to one side of said tape.

8. The pressure-sensitive grip measuring device as defined in claim 7, wherein said plurality of strips of electrically conductive material are made of a thin, somewhat deformable, metal material such as copper.

9. The pressure-sensitive grip measuring device as defined in claim 4, wherein said electrical indicator means is an electrical buzzer.

10. The pressure-sensitive grip measuring device as defined in claim 4, wherein said electrical indicator means is an electrical light.

11. The pressure-sensitive grip measuring device as defined in claim 4, wherein said circuit means for electrically connecting together said battery means, said electrical indicator means, said electrically conductive wrapping, and said electrically conductive shaft is a plurality of wires.

12. The pressure-sensitive grip measuring device as defined in claim 11, wherein said plurality of wires are typical copper wires.

13. The pressure-sensitive grip measuring device as defined in claim 1, further comprising a head of said hand manipulated implement, said head attached to said electrically conductive shaft at a second end thereof.

14. The pressure-sensitive grip measuring device as defined in claim 13, wherein said electrical indicator means and said battery means are disposed within said electrically conductive shaft.

15. The pressure-sensitive grip measuring device as defined in claim 14, wherein said grip means, said head of said hand manipulated implement, and said circuit means are weighted so as to simulate an actual weight of said hand manipulated implement.

16. The pressure-sensitive grip measuring device as defined in claim 15, wherein said grip means further comprises a protective material annularly disposed around said electrically conductive wrapping.

17. The pressure-sensitive grip measuring device as defined in claim 16, wherein said electrically conductive shaft is made of an electrically conductive rigid metal material such as aluminum or steel.

18. The pressure-sensitive grip measuring device as defined in claim 16, wherein said elastic insulating rings are made of a non-electrically conductive resilient material such as rubber.

19. The pressure-sensitive grip measuring device as defined in claim 16, wherein said electrically conductive wrapping is comprised of:

a sheet of double-backed tape; and a plurality of strips of electrically conductive material fastened to one side of said tape.

20. The pressure-sensitive grip measuring device as defined in claim 19, wherein said plurality of strips of electrically conductive material are made of a thin, somewhat deformable, metal material such as copper.

21. The pressure-sensitive grip measuring device as defined in claim 16, wherein said electrical indicator means is an electrical buzzer.

22. The pressure-sensitive grip measuring device as defined in claim 16, wherein said electrical indicator means is an electrical light.

23. The pressure-sensitive grip measuring device as defined in claim 16, wherein said circuit means for electrically connecting together said battery means, said electrical indicator means, said electrically conductive wrapping, and said electrically conductive shaft is a plurality of wires.

24. The pressure-sensitive grip measuring device as defined in claim 23, wherein said plurality of wires are typical copper wires.

* * * * *